US006176459B1

(12) United States Patent
Wilcox et al.

(10) Patent No.: US 6,176,459 B1
(45) Date of Patent: Jan. 23, 2001

(54) SELF-LOCKING ANGULARLY-TILTING SEAT SUPPORT

(75) Inventors: Jeffrey S. Wilcox, East Grand Rapids; Christopher A. Rossman, Comstock Park, both of MI (US); Warwick M. Whitley, Burnett, TX (US)

(73) Assignee: Attwood Corporation, Lowell, MI (US)

( * ) Notice: Under 35 U.S.C. 154(b), the term of this patent shall be extended for 0 days.

(21) Appl. No.: 09/280,728

(22) Filed: Mar. 29, 1999

(51) Int. Cl.[7] ..... A46G 29/00

(52) U.S. Cl. ..... 248/371; 248/419; 248/414; 297/344.12; 403/94

(58) Field of Search ..... 248/371, 372.1, 248/419, 422, 425, 404–414; 297/300.1, 313, 344.12, 344.13; 403/84, 93, 94

(56) References Cited

U.S. PATENT DOCUMENTS

| | | | | |
|---|---|---|---|---|
| 695,951 | | 3/1902 | Seymoure . | |
| 699,932 | | 5/1902 | Smith . | |
| 850,453 | | 4/1907 | Winans . | |
| 1,114,062 | | 10/1914 | Steinmetz . | |
| 1,116,947 | | 11/1914 | Steinmetz . | |
| 1,344,940 | | 1/1920 | Gavin . | |
| 1,708,761 | | 4/1929 | Horbath . | |
| 2,595,901 | | 5/1952 | Sperring | 155/157 |
| 2,759,528 | | 8/1956 | Rachman et al. | 155/137 |
| 2,764,223 | | 9/1956 | Mischke | 155/95 |
| 3,642,244 | * | 2/1972 | Textoris | 248/188.4 |
| 3,741,511 | * | 6/1973 | Streeter | 248/371 |
| 3,873,054 | | 3/1975 | McKee et al. | 248/371 |
| 3,933,330 | * | 1/1976 | Gwin | 248/371 |
| 3,940,181 | * | 2/1976 | Cheek, Jr. | 297/439 |
| 3,975,050 | | 8/1976 | McKee | 297/328 |
| 4,384,742 | * | 5/1983 | Wisinewski | 297/353 |
| 4,463,632 | * | 8/1984 | Parke | 81/177.9 |
| 4,645,871 | * | 2/1987 | Wang | 403/93 |
| 4,688,817 | * | 8/1987 | Marier | 280/278 |
| 5,265,969 | * | 11/1993 | Chuang | 403/94 |
| 5,297,849 | | 3/1994 | Chancellor | 297/344.12 |
| 5,725,281 | * | 3/1998 | Vairinen | 297/423.26 |
| 5,882,076 | * | 3/1999 | Garelick et al. | 297/344.18 |
| 5,921,695 | * | 7/1999 | Warner | 403/84 |
| 6,082,680 | * | 7/2000 | Woodward et al. | 248/1 |
| 6,102,479 | * | 8/2000 | Wallace | 297/357 |

* cited by examiner

*Primary Examiner*—Leslie A. Braun
*Assistant Examiner*—Walter Landry
(74) *Attorney, Agent, or Firm*—Price, Heneveld, Cooper, DeWitt & Litton

(57) ABSTRACT

A self-locking, angularly-tilting seat support is provided for supporting fishing boats and the like. The seat support includes a mounting plate adapted to support a seat thereon. A support stud has its upper end pivotally attached to the bottom of the mounting plate and its upper end slidably received within a pedestal. A pivot block is fixedly attached to the bottom of the mounting plate. A bushing is slidably mounted about the support stud and abuts the pedestal support. The pivot block and the bushing matably engage at a plurality of angular positions such that downward forces exerted on the mounting plate are transferred to the pivot block thereby effecting locking engagement between the pivot block and the bushing. The mounting plate may be selectively positioned between a plurality of angular positions relative to the support stud4by exerting an upward force on the mounting plate thereby causing the support stud to slide upwardly through the pedestal allowing the bushing to slide downwardly relative to the support stud thereby disengaging the bushing from the pivot block and allowing the mounting plate to be pivoted relative to the support stud.

35 Claims, 6 Drawing Sheets

SELF-LOCKING ANGULARLY-TILTING SEAT SUPPORT

BACKGROUND OF THE INVENTION

The present invention relates to seat supports and the like, and in particular to a self-locking, angularly-tilting support for fishing boat seats and the like.

Adjustable seat support systems are used in a wide variety of boat seating applications. Boat seat applications typically include a boat seat, a mounting plate to which the boat seat is mounted, and a pedestal supporting the mounting plate above the floor of the boat.

Heretofore, seat support systems have normally provided the user with the ability to pivot the seat about the pedestal, thereby allowing the user to face the seat in varying directions. Other seat support systems have provided the user with the ability to adjust the plane of the seat with respect to the horizontal or to horizontally pivot the seat. The seating support systems allowing for the horizontal pivoting of the seat are typically clumsy and require the use of two hands to adjust the seat. Still others require the user to dismount the seat in order to adjust the seat with respect to horizontal.

SUMMARY OF THE INVENTION

One aspect of the present invention is to provide a self-locking, angularly-tilting support for fishing boat seats and the like. The seat support includes a mounting plate adapted to support a seat thereon. A support stud has a first end pivotally attached to the bottom of the mounting plate and a second end adapted to be slidably received with an associated pedestal. A pivot block is fixedly attached to the bottom of the mounting plate. A bushing is slidably mounted on the support stud and is adapted to abut the pedestal. The pivot block and the bushing are configured to matably engage at a plurality of angular positions such that downward forces exerted on the mounting plate are transferred to the pivot block thereby effecting locking engagement between the pivot block and the bushing. The mounting plate may be selectively positioned between a plurality of angular positions relative to the support stud by exerting an upward force on the mounting plate, thereby causing the support stud to slide upwardly through the pedestal allowing the bushing to slide downwardly relative to the support stud, thereby disengaging the bushing from the pivot block and allowing the mounting plate to be pivoted relative to the support stud.

Another aspect of the present invention is to provide in a fishing boat seat of the type having a removable seat and a detachable pedestal supporting the seat on an associated boat surface, having an improvement of a self-locking, angularly-tilting seat mount comprising a mounting plate having a top shaped to support the seat thereon and a bottom, and a support stud having a first end pivotally attached to the bottom of the mounting plate, and a second end slidably received within an upper end of the pedestal. The seat mount further comprises a pivot block fixedly attached to the bottom of the mounting plate and a bushing slidably mounted about the support stud and abutting the pedestal. The pivot block and the bushing are configured to matably engage at a plurality of angular positions such that downward forces exerted on the mounting plate are transferred the pivot block, thereby effecting engagement between the pivot block and the bushing. The seat is selectively positionable between a plurality of angular positions relative to the pedestal by exerting an upward force on the seat, thereby causing the support stud to slide upwardly relative to the bushing, thereby disengaging the pivot block from the bushing, allowing the seat to be pivoted relative to the pedestal.

Yet another aspect of the present invention is to provide a self-locking, angularly-tilting seat support for fishing boat seats and the like, wherein the seat support includes a mounting plate, a support stud having a first end pivotally attached to the bottom of the mounting plate and a second end adapted to be slidably received within an associated pedestal, and a pivot block fixedly attached to the bottom of the mounting plate and adapted to allow the support stud to pivot relative to the mounting plate. A bushing is slidably mounted about the support stud and adapted to abut the pedestal. The pivot block and the bushing are adapted to matably engage such that the mounting plate may be selectively positioned at different angular positions relative to the support stud.

Another aspect of the present invention is to provide a method for adjusting a self-locking, angularly-tilting seat support for fishing boat seats and the like. The method includes providing a mounting plate, providing a support stud having a first end pivotally attached to the bottom of the mounting plate and a second end adapted to be pivotally and slidably received within an associated pedestal, and providing a pivot block fixedly attached to the bottom of the mounting plate and adapted to allow the support stud to pivot relative to the mounting plate. The method further includes providing a bushing slidably mounted about the support stud and adapted to engage the pedestal and to matably engage with the pivot block at a plurality of locations such that the mounting plate may be selectively positioned at a plurality of angular positions relative to the support stud. The method still further includes pivotally adjusting the mounting plate to different angular positions relative to the support stud by creating an upward force on the support stud thus decreasing the downward force acting on the pivot block and causing the support stud to slide relative to the support stud and disengage from the pivot block, pivoting the seat relative to the support stud, and removing the upward force acting on the support stud such that downward forces effect an engagement between the pivot block and the bushing.

Still another aspect of the present invention is to provide a self-locking, angularly-tilting seat support for fishing boat seats and the like, wherein the seat support includes a mounting plate adapted to support a seat, a support stud having a first end pivotally attached to the bottom of the mounting plate and a second end shaped to be slidably received within an associated pedestal, and pivot brackets fixedly attached to the bottom of the mounting plate, positioned about the support stud, and adapted to allow the support stud to pivot relative to the mounting plate. The seat support further includes a bushing slidably mounted with respect to the support stud and adapted to engage the pivot brackets, and a biasing spring biasing said bushing into engagement with the pivot brackets. The mounting plate is pivotable between a plurality of angular positions relative to the support stud by exerting a downward force on the bushing, thereby overcoming the biasing force of the spring allowing the bushing to disengage the pivot brackets and the mounting plate to be pivoted relative to the support stud.

The principal objectives of the present invention are to provide a self-locking, angularly-tilting support for fishing boat seats and the like. The utilization of the engagement between the pivot block and the bushing provides a seat support that allows a user to adjust the seat relative to the horizontal with one hand while providing a stable and positively engaged platform from which to support the seat while in use.

These and other features, advantages, and objects of the present invention will be further understood and appreciated by those skilled in the art by reference to the following written specification, claims, and appended drawings.

DETAILED DESCRIPTION OF PREFERRED EMBODIMENT

For purposes of description herein, the terms "upper," "lower," "right," "left," "rear," "front," "vertical," "horizontal," and derivatives thereof shall relate to the invention as oriented such that a user faces "forward" when seated in the seat. However, it is to be understood that the invention may assume various alternative orientations and step sequences, except where expressly specified to the contrary. It is also to be understood that the specific devices and processes illustrated in the attached drawings and described in the following specifications are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
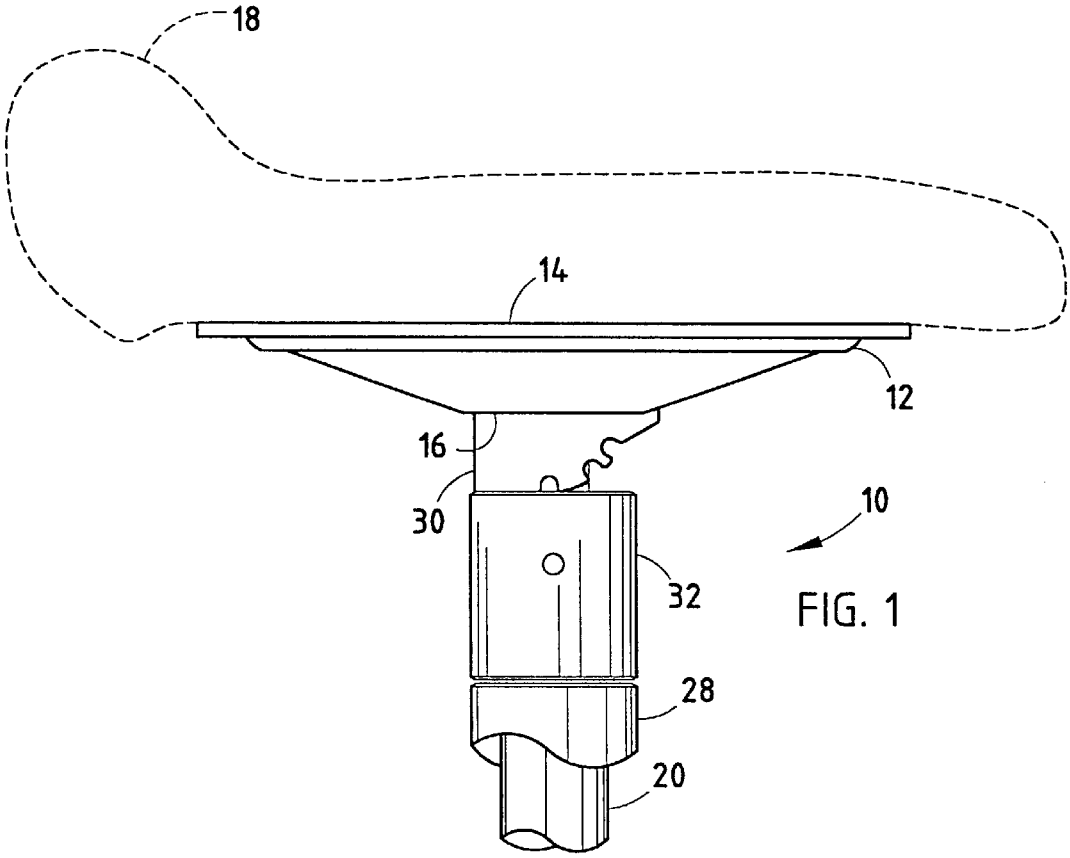
FIG. 1 is a side elevational view of a seat support embodying the present invention.
Figure 2:
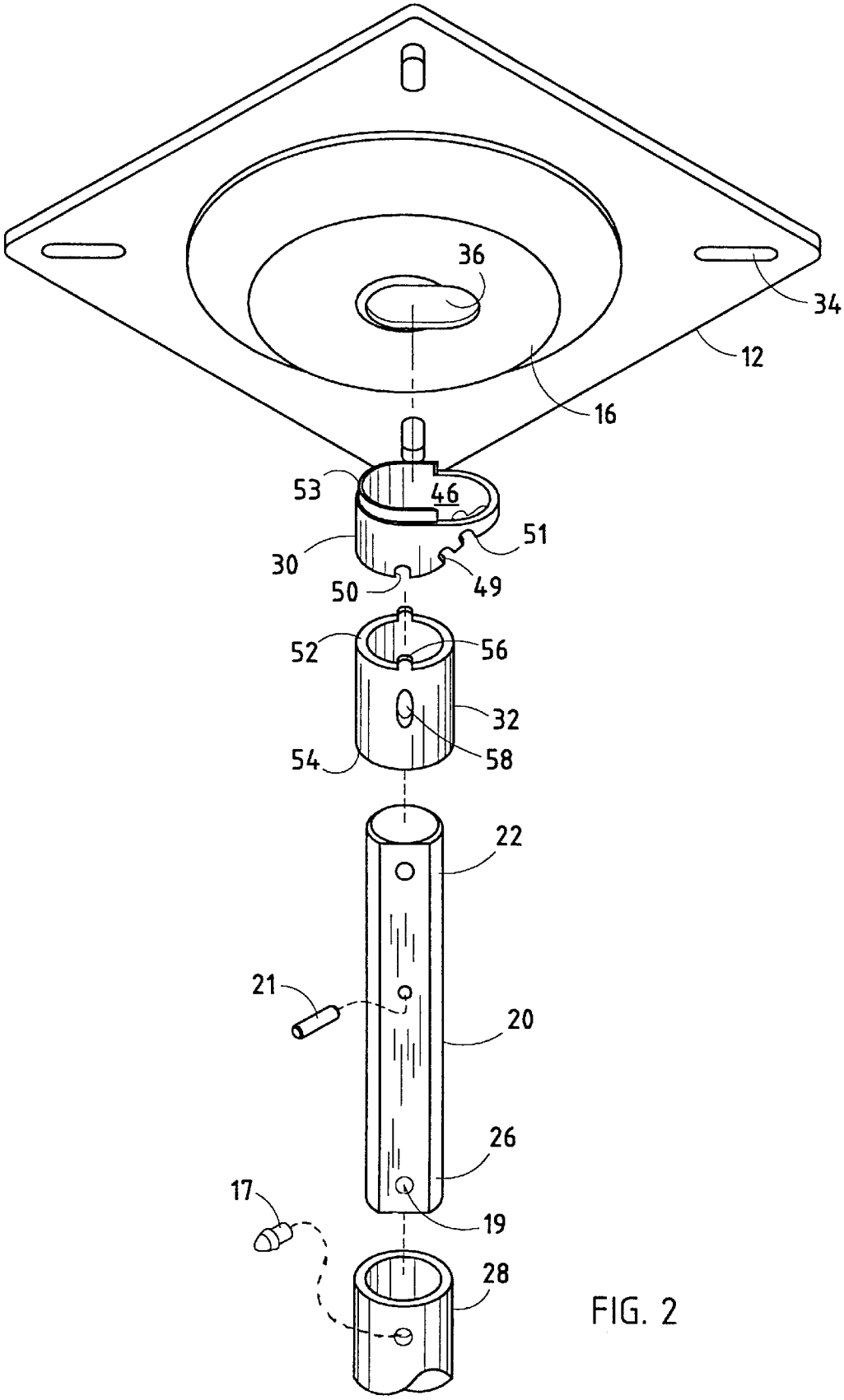
FIG. 2 is an exploded isometric view of the seat support.
Figure 7:
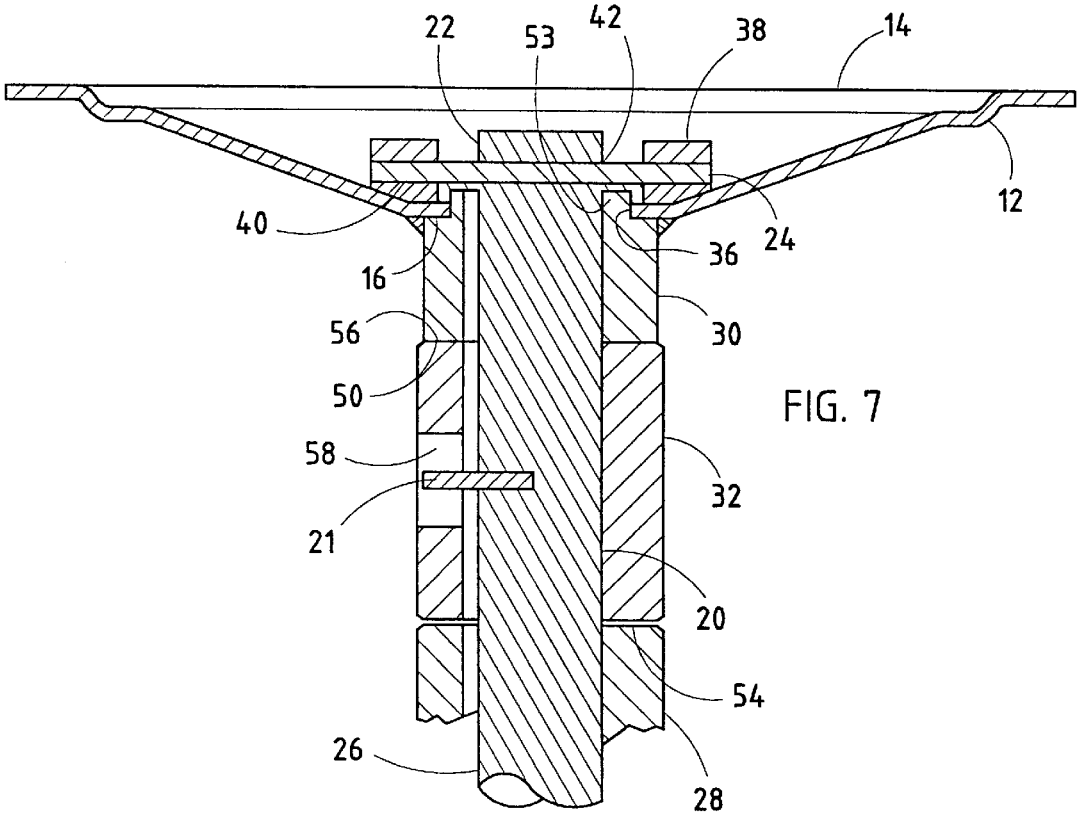
FIG. 7 is a front cross-sectional view of the support.

The reference numeral 10 (FIGS. 1 and 2) generally designates a self-locking, angularly-tilting seat support 10 embodying the present invention. In the illustrated example, the seat support includes a mounting plate 12 having a top 14 and a bottom 16, wherein the top 14 of the mounting plate 12 is adapted to support a seat 18 thereon. A support stud 20 has a first end 22 pivotally attached by way of pivot pin 24 (FIG. 7) to the bottom 16 of the mounting plate 12, and a second end 26 shaped to be slidably received within an associated pedestal 28. A pivot block 30 is fixedly attached to the bottom 16 of the mounting plate 12. The pivot block 30 is adapted to allow the support stud 20 to pivot relative to the mounting plate 12. A bushing 32 is slidably mounted about the support stud 20 and is adapted to abut the pedestal 28. Pivot block 30 and bushing 32 are adapted to matably engage at a plurality of angular positions such that downward forces exerted on the seat 18, and transferred to the mounting plate 12, are transferred to the pivot block 30, thereby effecting locking engagement between pivot block 30 and bushing 32. Mounting block 12 may be selectively positioned between a plurality of angular positions relative to support stud 20 by exerting an upward force on mounting plate 12, thereby causing support stud 20 to slide relative to bushing 32, thereby disengaging bushing 32 from pivot block 30 allowing mounting plate 12 to be pivoted relative to support stud 20.

The illustrated mounting plate 12 is provided top surface 14 and bottom surface 16, wherein top surface 14 is adapted to support seat 18 thereon. Mounting plate 12 is further provided with the plurality of mounting apertures 34 wherein mounting hardware (not shown) may be used to attach seat 18 to mounting plate 12. Mounting plate 12 is further provided with a centrally located aperture 36 and two upwardly extending pivot tabs 38 (FIG. 7) juxtaposed about aperture 36. Each pivot tab 38 is provided with a centrally located pivot aperture 40.

Support stud 20 (FIGS. 2 and 7) is cylindrically shaped and is provided with first end 22, second end 26 and a flat surface 25. First end 22 of support stud 20 is provided with a pivot aperture 42 extending therethrough, and is pivotally attached to mounting plate 12 by way of pivot pin 24 extending through pivot aperture 42 of support stud 20 and into pivot apertures 40 of pivot tabs 38. Aperture 36 of mounting plate 12 is adapted to allow support stud 20 to be pivoted about pivot pin 24 such that mounting plate 12 may be pivoted up to 90° relative to support stud 20. Flat surface 25 extends longitudinally along support stud 20. Support stud 20 is further provided with an outwardly extending slide pin 21 and a locking aperture 19 located near second end 26.

Pedestal 28 (FIG. 2) is alternately provided a spring biased locking pin 17. In assembly, locking pin 17 engages aperture 19 of support stud 20, thereby retaining support stud 20 within pedestal 28 when the seat support 10 is subjected to shocking forces such as those generated by rough water. Locking pin 17 is operable between an engagement position wherein locking pin 17 extends within the interior of pedestal 28, and a retracted position wherein the pin is held out of the interior of pedestal 28.

Figure 3:
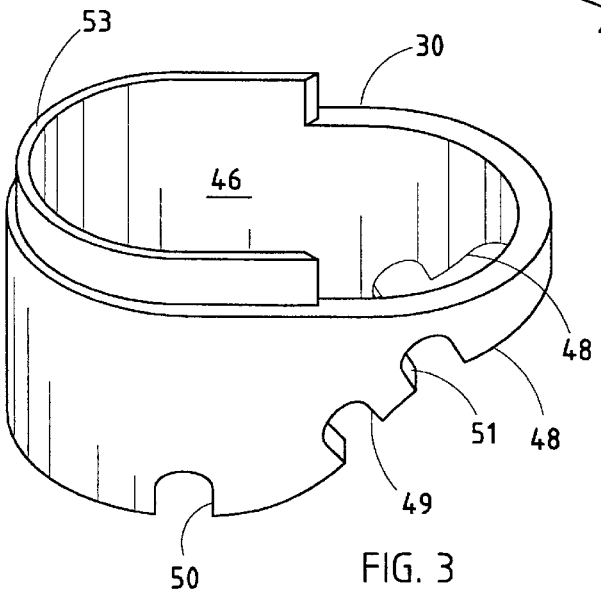
FIG. 3 is a top isometric view of a pivot block.

In the illustrated example, pivot block 30 (FIG. 3) has a generally annular shape defining a central aperture 46 therein, and two opposing, downwardly extending engagement walls 48. Each engagement wall 48 has a generally arcuate side elevational shape and is provided with three corresponding downwardly opening notches 49, 50 and 51 located at 45°, 90° and parallel relative to horizontal, respectively. Aperture 46 of pivot block 30 is adapted such that mounting plate 12 may be rotated up to 90° relative to support stud 20. Pivot block 30 is further provided with a upwardly extending collar 53 that extends about an uppermost portion of pivot block 30 and is adapted so as to mate within aperture 36 (FIG. 2) of mounting plate 12, thereby assuring proper alignment of pivot block 30 within aperture 36. Pivot block 30 is attached to mounting plate 12 such that aperture 46 of pivot block 30 is centered about aperture 36 of mounting plate 12.

Figure 4:
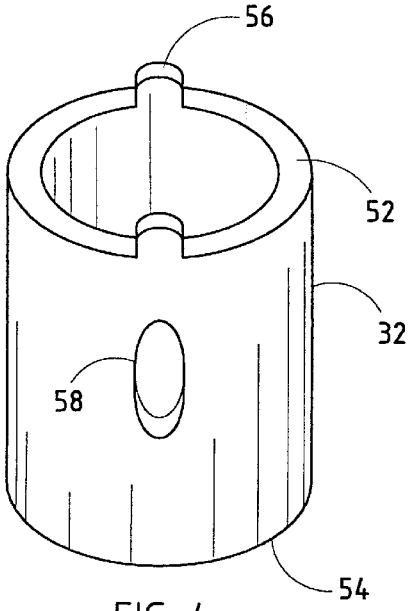
FIG. 4 is a top isometric view of a bushing.
Figure 6:
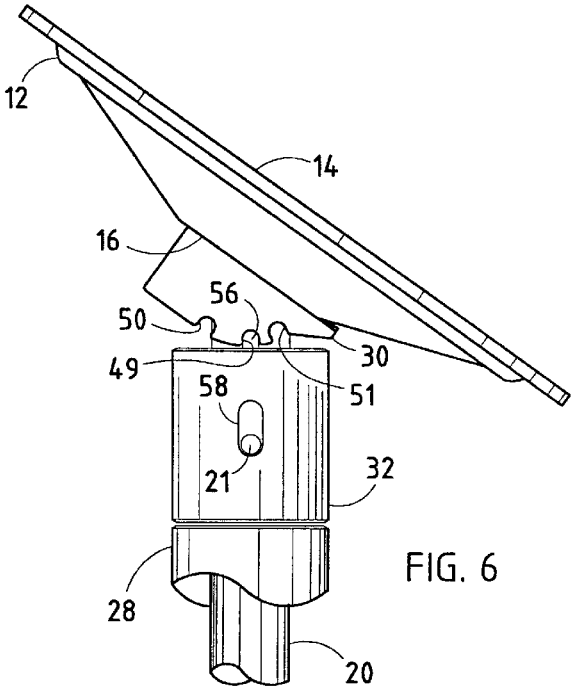
FIG. 6 is a left side elevational view of the seat support a mounting plate associated there with tilted at a 45° angle.

In the illustrated embodiment, bushing 32 (FIG. 4) is cylindrically shaped and slidably mounted about support stud 20. Bushing 32 is provided a first end 52 and a second end 54. First end 52 of bushing 32 is provided with two upwardly extending, juxtaposed lugs 56 adapted for engagement within notches 49, 50 and 51 of pivot block 30. Second end 54 of bushing 32 is adapted to abut pedestal support 28. Bushing 32 is further provided with a longitudinally extending elongated aperture 58.

In assembly, support stud 20 (FIG. 7) is pivotally attached to mounting plate 12 within aperture 36 by pivot pin 24 that extends through pivot aperture 42 of support stud 20 and into pivot apertures 40 of pivot tabs 38. Pivot block 30 is fixedly attached to bottom surface 16 of mounting plate 12 such that collar 53 fits within aperture 36 of mounting plate 12 and support stud 20 downwardly extends through aperture 46 of pivot block 30. Bushing 32 is located about support stud 20 such that slide pin 21 of support stud 20 extends within aperture 58 of bushing 32 thereby limiting longitudinal movement of bushing 32 along support stud 20. Seat 18 (FIG. 1) is fixedly attached to top surface 14 of mounting plate 12 by way of mechanical fasteners (not shown) extending through mounting apertures 34 of mounting plate 12 and into seat 18. Second end 26 of support stud 20 is pivotally and telescopingly slidably engaged within pedestal support 28 such that second end 54 of bushing 32 engages pedestal support 28.

In operation, downward forces exerted on seat 18 (FIG. 1) are transferred to mounting plate 12 and pivot block 30. The downward forces transferred to the pivot block cause lugs 56 of bushing 32 to positively and securely engage notches 50 of pivot block 30. The plane defined by seat 18 and mounting plate 12 may be pivoted with respect to support stud 20 by engaging and disengaging bushing 32 from pivot block 30. The user of the seat can easily and quickly adjust the relative angle of the seat 18 with respect to pedestal support 28 by removing the downward pressure exerted by the user onto seat 18.

Figure 5:
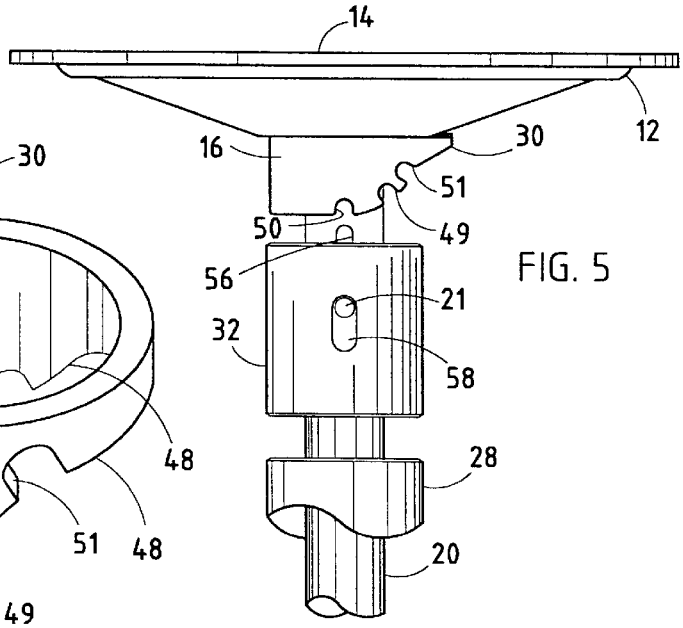
FIG. 5 is a side elevational view of the seat support shown in a raised position.

To adjust the relative angle of the seat 18 with respect to the pedestal support 28 (FIG. 5), the user reduces the downwardly directed gravitational forces acting on seat 18 by lifting seat 18 upward, thereby reducing the downward pressure on support stud 20 and pivot block 30. Support stud 20 slides upwardly through pedestal support 28 allowing bushing 32 to slide downwardly relative to support stud 20 thereby disengaging lugs 56 of bushing 32 from notches 50 of pivot block 30. After the bushing 32 has disengaged the pivot block 30, the operator may change the relative angle between the seat 18 and support stud 20 by pivoting mounting plate 12 about pivot pin 44. The operator then releases the upward force on seat 18, thereby allowing lugs 56 of bushing 32 reengage notches 50 of pivot block 30. Seat 18 may be adjusted to relative angles of 45°, 90° and parallel relative to support stud 20 by selecting notch 49, 51, or 50, respectively.

Figure 8:
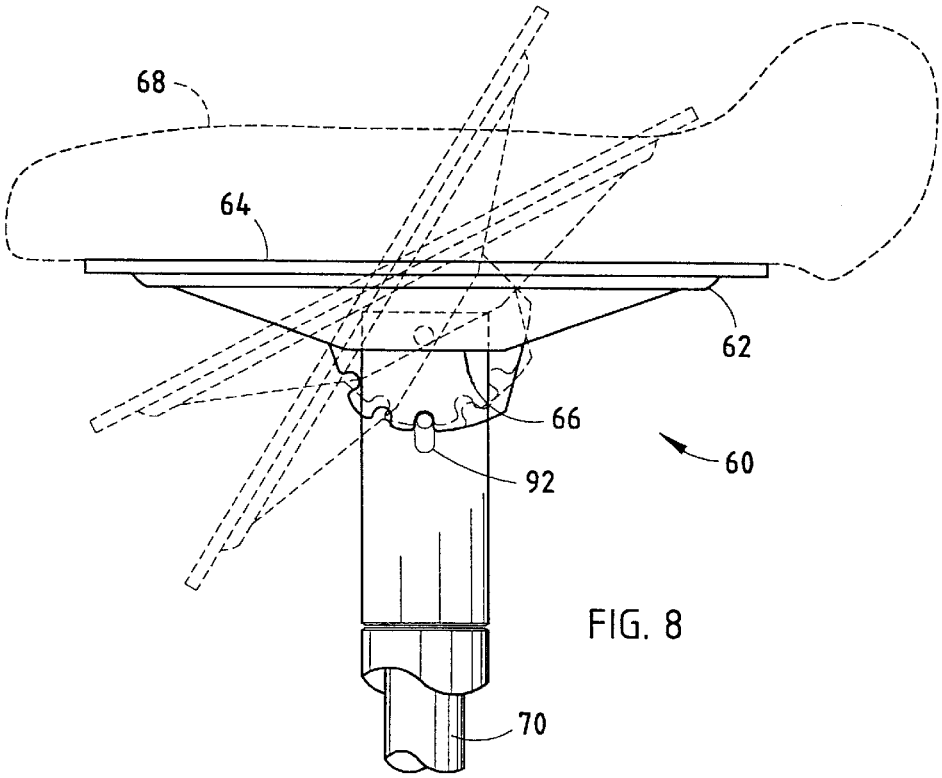
FIG. 8 is a side elevational view of a front alternate embodiment of the seat support showing the mounting plate in a plurality of angular positions.
Figure 9:
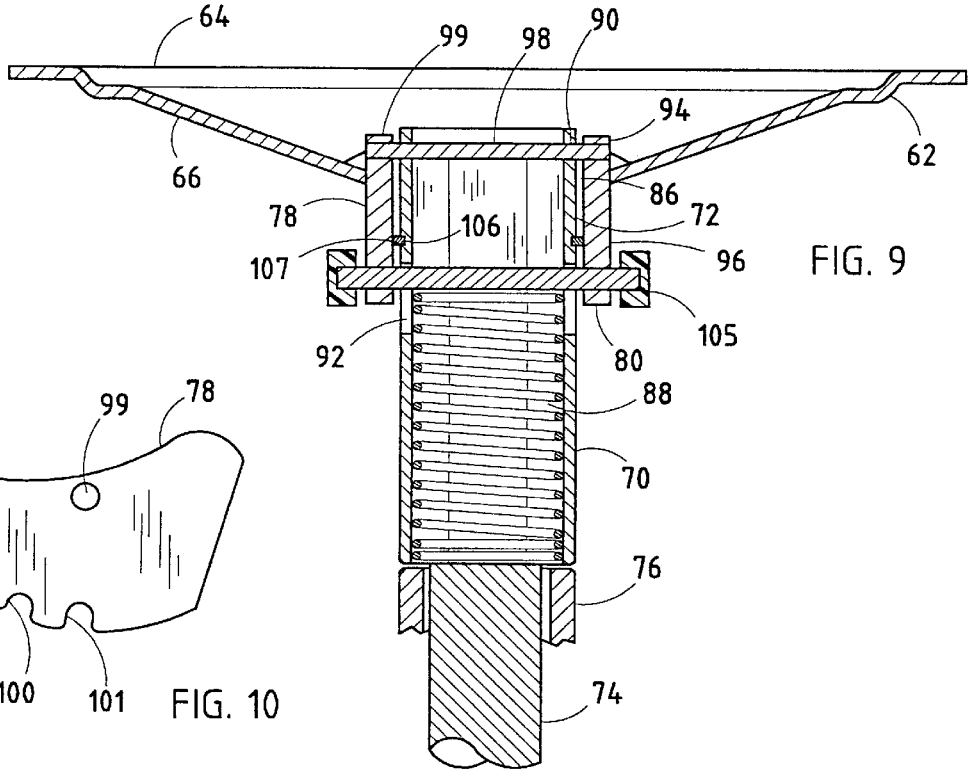
FIG. 9 is a front cross-sectional view of the first alternate embodiment.

The reference numeral 60 (FIGS. 8 and 9) generally designates another embodiment of the present invention. The illustrated seat support 60 includes a mounting plate 62 having a top surface 64 and a bottom surface 66. Top surface 64 of mounting plate 62 is adapted to support a seat 68 thereon. A support stud 70 has a first end 72 pivotally attached to bottom surface 66 of mounting plate 62, and an second end 74 adapted to be pivotally and telescopingly slidably received within a pedestal support 76. A pair of downwardly extending pivot brackets 78 are attached to mounting plate 62. A bushing 80 is slidably mounted within support stud 70 and is adapted to matably engage pivot brackets 78. A biasing spring 82 is positioned so as to bias bushing 80 into engagement with pivot brackets 78. Mounting plate 62 is pivotable between a plurality of angular positions relative to support stud 70 by exerting a downward force on bushing 80 thereby overcoming the biasing force of spring 82, allowing bushing 80 to disengage pivot brackets 78, and mounting plate 62 to be pivoted relative to support stud 70.

Mounting plate 62 includes a top surface 64 and a bottom surface 66, wherein top surface 64 is adapted to support seat 68 thereon. Mounting plate 62 is further provided with a plurality of mounting apertures, similar to mounting apertures 34 of FIG. 2, for the locating of mounting hardware (not shown) therein, to mount seat 68 to top surface 64 of mounting plate 62. Mounting plate 62 is still further provided with a centrally located aperture 86.

Support stud 70 has an octagonal cross-sectional shape and is provided with first end 72 and second end 74. First end 72 of support stud 70 is provided with a hollow interior 88 and juxtaposed pivot apertures 90 extending therethrough. First end 72 of support stud 70 is further provided with elongated, longitudinally extending, juxtaposed bushing apertures 92. First end 72 of support stud 70 is further provided with a circumferentially extending channel 106 adapted to receive a rubber O-ring 107 therein. O-ring 107 is sized to fill the distance between the support stud 70 and the pivot brackets 78.

Figure 10:
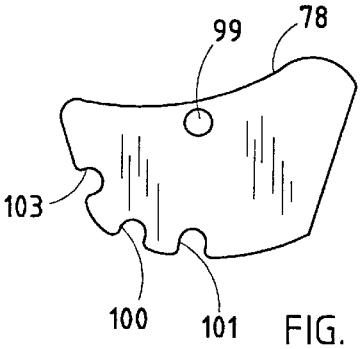
FIG. 10 is a side elevational view of a pivot bracket.

Pivot brackets 78 are attached to and extend downwardly from mounting plate 62 pivot. Pivot brackets 78 are attached to mounting plate 62 so as to define each pivot bracket 78 with a first portion 94 extending above bottom surface 66 of mounting plate 62 and a second portion 96 extending below bottom surface 66 of mounting plate 62. First portion 94 of each pivot bracket 78 is provided with a centrally located pivot pin aperture 99 extending therethrough. Second portion 96 (FIG. 10) of each pivot bracket 78 is provided with a substantially arcuate shape and a plurality of downwardly opening notches 100, 101 and 103 located therein at 45°, 90° and parallel relative to horizontal, respectively.

Bushing 80 is provided in the shape of a pin adapted to engage notches 100, 101 and 103 of pivot brackets 78. A pair of knobs 105 are operably connected to each end of pin 80 and are adapted such that the operator may shift the position of pin 80 within aperture 92 by way of knobs 105.

In assembly, pivot brackets 78 are attached to mounting plate 62 by way of welding, however, other methods of attaching pivot walls 78 to mounting plate 62 may be employed, including but not limited to, spot welding, mechanical fasteners, and/or integrally molding pivot bracket 78 and mounting plate 62. Spring 82 is positioned within hollow interior 88 of first end 72 of support stud 70, and pin 80 is extended through apertures 92 of support stud 70 such that spring 82 biases pin 80 towards an end of each aperture 92 of support stud 70. Support stud 70 is pivotally attached to mounting plate 60 by way of a pivot pin 102 that extends through pivot apertures 90 of support stud 70 and pivot pin apertures 98 of pivot brackets 78. Support stud 70 and pivot brackets 78 are adapted such that bushing pin 80 positively engages any of notches 100, 101, or 103 of pivot brackets 78. Second end 74 of support stud 70 is pivotally and telescopingly slidably positioned within pedestal support 76. Pin 80 may be made more accessible to the operator by connecting knobs 105 thereto.

In operation, the operator adjusts the plane as defined by seat 68 and mounting plate 62 relative to support stud 70 by disengaging bushing pin 80 from engagement within any of notches 100, 101, or 103 of pivot brackets 78, thereby allowing the operator to pivot mounting plate 62 about pivot pin 102. More specifically, an operator may grasp either knob 105 and apply a downward pressure thereto, thereby overcoming the biasing force exerted by spring 82 on bushing pin 80. After the bushing pin 80 has been disengaged from any one of notches 100, 101, or 103 of pivot brackets 78, mounting plate 62 may be pivoted freely about pivot pin 102. The operator then selects another angular position for seat 68 and releases knobs 105, thereby allowing spring 82 to bias pin 80 into engagement within any one of notches 100, 101, or 103 of pivot brackets 78.

Figure 11:
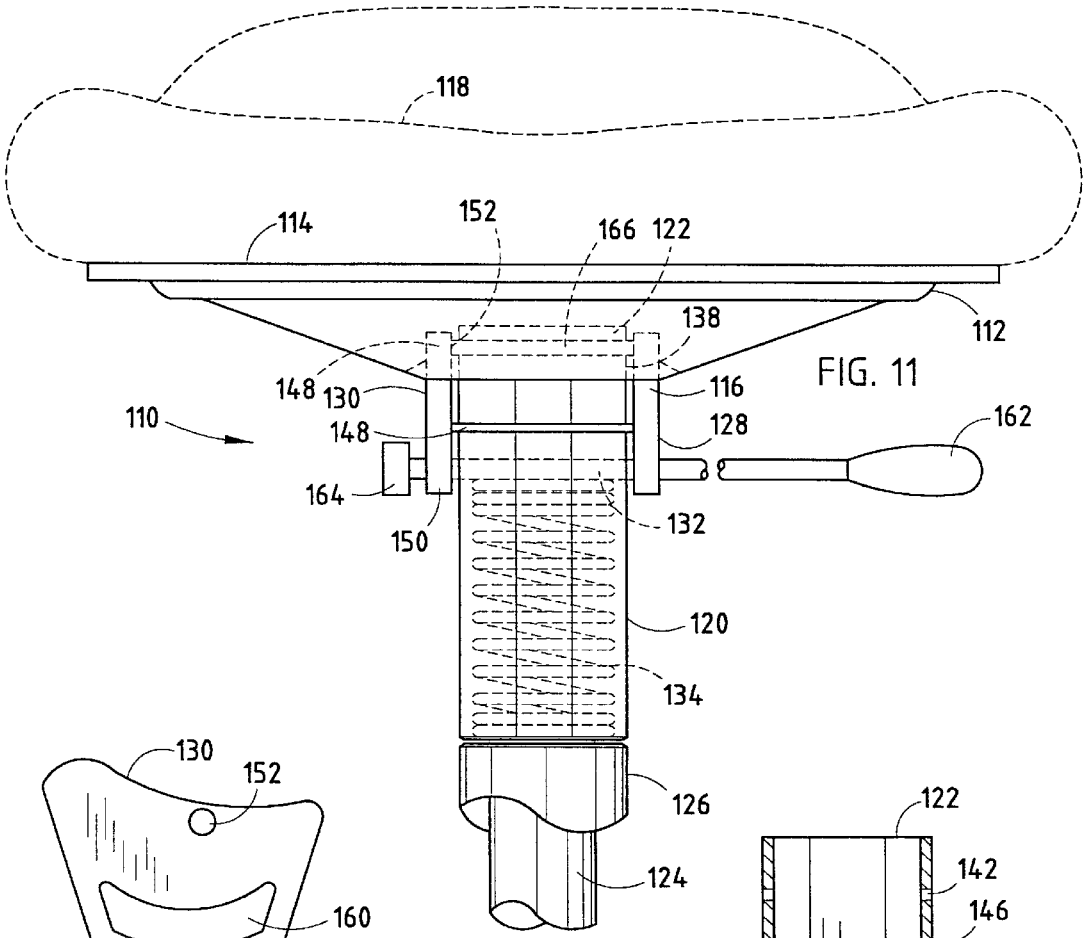
FIG. 11 is a side elevational view of a second alternate embodiment.

The reference numeral 110 (FIG. 11) generally designates yet another embodiment of the present invention. The illustrated seat support 110 includes a mounting plate 112 having a top surface 114 and a bottom surface 116. Top surface 114 of mounting plate 62 is adapted to support a seat 118 thereon. A support stud 120 has a first end 122 pivotally attached to bottom surface 116 of mounting plate 62, and a second end 124 adapted to be pivotally and telescopingly slidably received within a pedestal support 126. A first pivot bracket 128 and a second pivot bracket 130 are attached to and downwardly extend from mounting plate 62. A bushing 132 is slidably mounted within support stud 120 and is adapted to matably engage first pivot bracket 128. A biasing spring 134 is positioned so as to bias bushing 132 into engagement with first pivot bracket 128. Mounting plate 112 is pivotable between a plurality of angular positions relative to support stud 120 by exerting a downward force on bushing 132, thereby overcoming the biasing force of spring 134, allowing bushing 132 to disengage first pivot bracket 128, and mounting plate 112 to be pivoted relative to support stud 120.

Mounting plate 112 is provided top surface 114 and bottom surface 116, wherein top surface 114 is adapted to support seat 118 thereon. Mounting plate 112 is further provided with a plurality of mounting apertures, similar to mounting apertures 34 of FIG. 2, for the locating of mounting hardware (not shown) therein, to mount seat 118 to top surface 114 of mounting plate 112. Mounting plate 112 is still further provided with a centrally located aperture 138.

Figure 14:
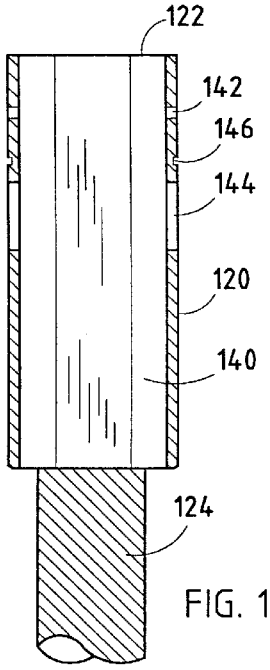
FIG. 14 is a cross-sectional view of a support stud.

Support stud 120 (FIGS. 11 and 14) has an octagonal cross-sectional shape and is provided with first end 122 and second end 124. First end 122 of support stud 120 is provided with hollow interior 140, pivot pin apertures 142, longitudinally extending, elongated bushing apertures 144, and cirumferentially extending channel 146. Channel 146 is adapted for receiving a rubber O-ring 148 therein that is sized to fill the distance between the support stud 120 and first and second pivot brackets 128 and 130, respectively.

Figure 12:
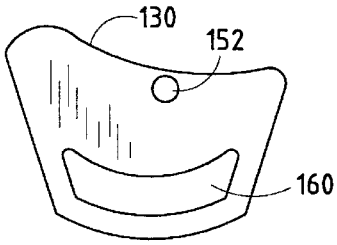
FIG. 12 is a side elevational view of a slide bracket.
Figure 13:
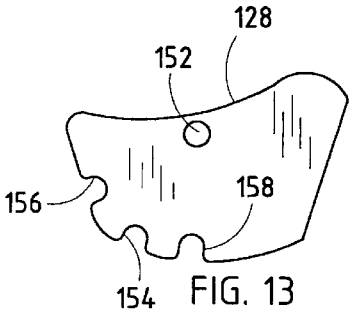
FIG. 13 is a side elevational view of a pivot bracket.

First pivot bracket 128 and second pivot bracket 130 are each attached to and extend downwardly from mounting plate 112 so as to define each pivot bracket 128 and 130 with a first portion 148 extending above bottom surface 116 of mounting plate 112 and a second portion 150 extending below bottom surface 116 of mounting plate 112. First portion 148 of each pivot bracket 128 and 130 is provided with centrally located pivot aperture 152 extending therethrough. Second portion 150 (FIGS. 12 and 13) of each pivot bracket 128 and 130 is provided with a substantially arcuate shape. Second portion 150 of first pivot bracket 128 is provided with a plurality of downwardly opening notches 154, 156 and 158 located therein at 45°, 90° and parallel relative to horizontal, respectively. Second portion 150 of second pivot bracket 130 is provided with a substantially arcuately shaped channel 160 located therein.

Bushing 132 is provided in the shape of a pin adapted to engage notches 154, 156 and 158 of first pivot bracket 128, and channel 160 of second pivot bracket 130. A handle 162 is operably connected to an end of pivot pin 132 and is adapted such that the operator may shift the position of pin 132 within aperture 144 of support stud 120 by way of handle 162. A knob 164 is operably connected to the opposite end of pin 132 from handle 162.

In assembly, pivot brackets 128 and 130 are attached to mounting plate 112 by way of welding, however, other methods of attaching pivot brackets 128 and 130 to mounting plate 112 may be employed, including but not limited to, spot welding, mechanical fasteners, and/or integrally forming pivot brackets 128 and 130 and mounting plate 112. Spring 134 is positioned within hollow interior 140 of first end 122 of support stud 120, and pin 132 is extended through apertures 144 of support stud 120, such that spring 134 biases pin 132 towards an end of each bushing aperture 144 of support stud 120. Support stud 120 is pivotally attached to mounting plate 112 by way of a pivot pin 166 that extends through pivot apertures 142 of support stud 120 and pivot pin apertures 152 of pivot brackets 128 and 130. Support stud 120, first pivot bracket 128, and second pivot bracket 130 are adapted such that pin 132 positively engages any of notches 154, 156, or 158 of first pivot bracket 128. Second end 124 of support stud 120 is pivotally and telescopingly slidably positioned within pedestal support 126. Pin 132 may be made accessible to the operator by way of handle 162 and knob 164.

In operation, the operator adjusts the plane as defined by seat 118 and mounting plate 112 relative to support stud 120 by disengaging pin 132 from engagement within any of notches 154, 156, or 158 of first pivot bracket 128, thereby allowing the operator to pivot mounting bracket 112 about pivot pin 166. More specifically, the operator may grasp handle 162 and apply a downward pressure thereto, thereby pivoting pin 132 within channel 160 of second pivot bracket 130, thereby overcoming the biasing force exerted by spring 134 on pin 132. After pin 132 has been disengaged from any one of notches 154, 156, or 158 of first pivot bracket 128, mounting plate 112 may be pivoted freely about pivot pin 166. The operator then selects another angular position for seat 118 and releases handle 162, thereby allowing spring 134 to bias pin 132 into engagement within any one of the notches 154, 156, or 158.

Seat support 10 provides a greatly improved method for allowing the user/operator to adjust the relative angle between the boat seat and the pedestal support associated therewith, by allowing the user to adjust the angle of the seat with one hand while still providing a positively locking and stable base from which to support the seat when in use.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. A self-locking angularly-tilting seat support for pedestal fishing boat seats and the like, comprising:

a mounting plate having a top shaped to support a seat thereon, and a bottom;

a support stud having a first end pivotally attached to said bottom of said mounting plate and a second end configured to be slidably received within an associated pedestal;

a pivot block fixedly attached to said bottom of said mounting plate;

a bushing slidably mounted on said support stud, and adapted to abut said pedestal support;

said pivot block and said bushing being configured to matably engage at a plurality of angular positions such that downward forces exerted on said mounting plate are transferred to said pivot block thereby effecting locking engagement between said pivot block and said bushing, said mounting plate being selectively positionable between a plurality of angular positions relative to said support stud by exerting an upward force on said mounting plate, thereby causing said support stud to slide upwardly relative to said bushing, thereby disengaging said pivot block from said bushing and allowing said mounting plate to be pivoted relative to said support stud.

2. A seat support as set forth in claim 1, wherein:

said pivot block is provided with at least one downwardly extending arcuately shaped wall having a plurality of downwardly opening laterally extending notches located therein; and said bushing is provided with at least one upwardly extending lug adapted to engage at least one of said notches of said pivot block.

3. A seat support as set forth in claim 2, wherein:

said bushing is provided with a longitudinally extending aperture;

said support stud is provided with an outwardly extending guide pin; and said bushing is positioned about said support stud such that said pin of said support stud is located within said aperture of said bushing, whereby travel of said bushing along said support stud is limited.

4. A seat support as set forth in claim 3, wherein:

said pivot block is provided with two downwardly extending arcuately shape walls; and said walls of said pivot block are juxtaposed about said support stud.

5. A seat support as set forth in claim 4, wherein:

said support stud is cylindrically shaped.

6. A seat support as set forth in claim 5, wherein:

said support stud is adapted to be pivotally received within said pedestal.

7. A seat support as set forth in claim 6, wherein:

said notches are located within said pivot blocks such that said mounting plate may be positioned at substantially 45°, 90° and parallel relative to said support stud.

8. In a fishing boat seat of the type having a removable seat, and a detachable pedestal supporting the seat on an associated boat surface, this improvement of a self-locking angularly-tilting seat mount, comprising:

a mounting plate having a top shaped to support a seat thereon, and a bottom;

a support stud having a first end pivotally attached to said bottom of said mounting plate and a second end slidably received within an upper end of the pedestal;

a pivot block fixedly attached to said bottom of said mounting plate;

a bushing slidably mounted about said support stud, and abutting the pedestal;

said pivot block and said bushing being configured to matably engage at a plurality of angular positions such that downward forces exerted on said mounting plate are transferred to said pivot block thereby effecting locking engagement between said pivot block and said bushing, said seat being selectively positionable between a plurality of angular positions relative to said pedestal by exerting an upward force on said seat thereby causing said support stud to slide upwardly relative to said bushing thereby disengaging said pivot block from said bushing and allowing said seat to be pivoted relative to the pedestal.

9. A seat support as set forth in claim 8, wherein:

said pivot block is provided with at least one downwardly extending arcuately shaped wall having a plurality of downwardly opening laterally extending notches located therein; and said bushing is provided with at least one upwardly extending lug adapted to engage at least one of the said notches of said pivot block.

10. A seat support as set forth in claim 9, wherein:

said bushing is provided with a longitudinally extending aperture;

said support stud is provided with an outwardly extending guide pin; and said bushing is positioned about said support stud such that said pin of said support stud is located within said aperture of said bushing, whereby travel of said bushing along said support stud is limited.

11. A seat support as set forth in claim 10, wherein:

said pivot block is provided two downwardly extending arcuately shaped walls; and said walls of said pivot block are juxtaposed about said support stud.

12. A seat support as set forth in claim 11, wherein:

said support stud is cylindrically shaped.

13. A seat support as set forth in claim 12, wherein:

said support stud is adapted to be pivotally received within the pedestal.

14. A seat support as set forth in claim 13, wherein:

said notches are located within said pivot block such that the seat may be positioned at substantially 45°, 90° and parallel relative to said support stud.

15. A seat support set forth in claim 14, wherein:

said support stud is adapted to be lockingly pivotally received within the pedestal.

16. A self-locking, angularly-tilting seat support for pedestal fishing boat seats and the like, comprising:

a mounting plate having a top shaped to support a seat thereon and a bottom;

a support stud having a first end pivotally attached to said bottom of said mounting plate and a second end configured to be slidably received within an associated pedestal;

a pivot block fixedly attached to said bottom of said mounting plate;

a bushing slidably mounted on said support stud and adapted to abut said pedestal support;

said pivot block and said bushing being configured to matably engage such that said mounting plate may be selectively positioned at different angular positions relative to said support stud.

17. A seat support as set forth in claim 16, wherein:

said pivot block is provided with two arcuately shaped downwardly extending walls juxtaposed about said support stud having a plurality of corresponding downwardly opening laterally extending notches located therein;

said bushing is provided two upwardly extending lugs adapted to engage said notches of said pivot block;

whereby said mounting plate is selectively positionable between a plurality of angular positions relative to said support stud by exerting an upward force on said support stud, thereby causing said support stud to slide upwardly relative to bushing, thereby disengaging said lugs of said bushing from said notches of said pivot block and allowing said mounting plate to be pivoted relative to said support stud.

18. A seat support as set forth in claim 17, wherein:

an aperture extends longitudinally within said bushing;

a guide pin outwardly extends from said support stud; and said bushing is positioned about said support stud such that said pin of said support stud is located within said aperture of said bushing, whereby travel of said bushing along said support stud is limited.

19. A seat support as set forth in claim 18, wherein:

said support stud is cylindrically shaped.

20. A seat support as set forth in claim 19, wherein:

said support stud is adapted to be pivotally received within said pedestal.

21. A method for adjusting a self-locking, angularly-tilting seat support for pedestal fishing boat seats and the like, comprising:

providing a mounting plate having a top shaped to support a seat thereon, and a bottom;

providing a support stud having a first end pivotally attached to the bottom of the mounting plate and a second end configured to be pivotally and slidably received within an associated pedestal;

providing a pivot block fixedly attached to the bottom of the mounting plate;

providing a bushing slidably mounted on the support stud and configured to engage the pedestal and to matably engage with the pivot block at a plurality of locations such that the mounting plate may be selectively positioned at a plurality of angular positions relative to the support stud; and pivotally adjusting the mounting plate to different angular positions relative to the support stud by creating an upward force on the support stud thus decreasing the downward force acting on the pivot block and causing the support stud to slide upwardly relative to the bushing, allowing the bushing to disengage from the pivot block thereby allowing the seat to be pivoted relative to said support stud, then removing the upward force acting on the support stud such that downward forces effect an engagement between the pivot block and the bushing.

22. A method as set forth in claim 21, wherein:

said pivot block providing step includes providing the pivot block with downwardly extending arcuate walls juxtaposed about the support stud having a plurality of corresponding downwardly facing laterally extending notches disposed therein;

said bushing providing step includes providing the bushing with at least one upwardly extending lug; and said pivotally adjusting step includes positioning the bushing relative to the pivot block such that the lug of the bushing engages any one of the notches of the pivot block.

23. A method as set forth in claim 22, wherein:

said support stud providing step includes providing the support stud with an outwardly extending pin; and said bushing providing step includes providing the bushing with a longitudinally extending aperture and positioning the bushing about the support stud such that the pin of the support stud is located within the aperture of the bushing, whereby travel of the bushing along the support stud is limited.

24. A method as set forth in claim 23, wherein:

said pivot block providing step further includes providing the notches within the pivot blocks such that the mounting plate may be positioned at substantially 45°, 90° and parallel relative to the support stud.

25. A self-locking, angularly-tilting seat support for fishing boat seats and the like, comprising:

a mounting plate having a top and bottom, said top of said mounting plate adapted to attach to the bottom of a seat;

a support stud having a first end pivotally attached to said bottom of said mounting plate and a second end adapted to be slidably received within a pedestal support;

two downwardly extending pivot brackets fixedly attached to said bottom of said mounting plate and adapted to allow said support stud to pivot relative to said mounting plate;

a locking pin slidably mounted with respect to said support stud and adapted to engage at least one of said brackets;

a biasing spring biasing said pin into engagement with at least one of said brackets;

said mounting plate pivotable between a plurality of angular positions relative to said support stud by exerting a downward force on said pin, thereby overcoming the biasing force of said spring allowing said pin to disengage said bracket and said mounting plate to be pivoted relative to said support stud.

26. A seat support as set forth in claim 25, wherein:

said brackets are provided a downwardly extending arcuate shape.

27. A seat support as set forth in claim 26, wherein:

at least one of said brackets is provided with a plurality of downwardly opening laterally extending notches.

28. A seat support as set forth in claim 27, wherein:

said support stud is provided with a hollow interior and two longitudinally oriented and juxtaposed apertures; and said spring is located within said hollow interior of said support stud and said pin is located with said apertures of said support stud such that said spring biases said pin towards an end of said apertures and engagement with said notches of said bracket.

29. A seat support as set forth in claim 28, further including:

at least one handle operably connected to said pin whereby said pin may be slid within said apertures of said support stud by applying pressure to said handle.

30. A seat support as set forth in claim 29, wherein:

said handle includes at least one knob.

31. A seat support as set forth in claim 29, wherein:

said handle includes a knob and a lever attached to opposite ends of said pin.

32. A seat support as set forth in claim 31, wherein:

said support stud is cylindrically shaped.

33. A seat support as set forth in claim 32, wherein:

said support stud is adapted to be pivotally received within said pedestal.

34. A seat support as set forth in claim 33, wherein:

said notches are located within said pivot blocks such that said mounting plate may be positioned at substantially 45°, 90° and parallel to said support stud.

35. A seat support as set forth in claim 34, wherein:

said support stud is adapted to be lockingly pivotally received within said pedestal.

* * * * *